US010797396B2

(12) United States Patent
Kaspersson et al.

(10) Patent No.: US 10,797,396 B2
(45) Date of Patent: Oct. 6, 2020

(54) APERTURE COUPLED PATCH ANTENNA ARRANGEMENT

(71) Applicant: Telefonaktiebolaget LM Ericsson (publ), Stockholm (SE)

(72) Inventors: Ola Kaspersson, Varberg (SE); Anders Ek, Hisings Backa (SE); Håkan Karlsson, Gothenburg (SE)

(73) Assignee: Telefonaktiebolaget LM Ericsson (Publ), Stockholm (SE)

( * ) Notice: Subject to any disclaimer, the term of this patent is extended or adjusted under 35 U.S.C. 154(b) by 56 days.

(21) Appl. No.: 16/320,341

(22) PCT Filed: Jul. 25, 2016

(86) PCT No.: PCT/EP2016/067643
§ 371 (c)(1),
(2) Date: Jan. 24, 2019

(87) PCT Pub. No.: WO2018/019357
PCT Pub. Date: Feb. 1, 2018

(65) Prior Publication Data
US 2019/0229422 A1 Jul. 25, 2019

(51) Int. Cl.
*H01Q 13/00* (2006.01)
*H01Q 9/04* (2006.01)
(Continued)

(52) U.S. Cl.
CPC ..... *H01Q 9/0478* (2013.01); *H01Q 1/523* (2013.01); *H01Q 9/0407* (2013.01);
(Continued)

(58) Field of Classification Search
CPC ..... H01Q 1/243; H01Q 1/38; H01Q 9/0421; H01Q 1/244; H01Q 1/242; H01Q 9/145;
(Continued)

(56) References Cited

U.S. PATENT DOCUMENTS

2005/0195124 A1* 9/2005 Puente Baliarda ..... H01Q 1/36 343/893
2015/0162663 A1 6/2015 Boryssenko et al.
2015/0381229 A1* 12/2015 Tzanidis ..... H05K 1/0243 455/73

FOREIGN PATENT DOCUMENTS

EP 1 775 795 A1 4/2007
WO 2005/041352 A1 5/2005

OTHER PUBLICATIONS

International Search Report and Written Opinion dated Apr. 21, 2017 issued in International Application No. PCT/EP2016/067643. (10 pages).

(Continued)

*Primary Examiner* — Minh D A
(74) *Attorney, Agent, or Firm* — Patent Portfolio Builders, PLLC

(57) ABSTRACT

It is provided an aperture coupled patch antenna comprising a substrate comprising a planar electrically conductive ground plane, an electrically conductive box arranged on and electrically connected to the ground plane to form an air filled cavity between the box and the ground plane, the box comprising an aperture in the form of at least one elongate slot. The antenna further comprises an electrically conductive patch arranged in parallel with the ground plane and at a distance from the box such that the aperture of the box is located between the patch and the ground plane and a distribution network comprising at least one elongate distribution element arranged in parallel with the ground plane between the ground plane and the patch, at a distance from the substrate and the ground plane and at a distance from the box such that a gap is formed between the distribution element and the box, wherein the extension of the distribution element intersects the extension of the aperture.

15 Claims, 4 Drawing Sheets

(51) Int. Cl.
*H01Q 1/52* (2006.01)
*H01Q 21/06* (2006.01)
*H01Q 21/24* (2006.01)

(52) U.S. Cl.
CPC ..... *H01Q 9/0457* (2013.01); *H01Q 21/065* (2013.01); *H01Q 21/24* (2013.01)

(58) Field of Classification Search
CPC H01Q 9/30; H01Q 9/14; H01Q 23/00; H01Q 13/18; H01Q 9/0407; H01Q 1/286; H01Q 5/0003; H01Q 5/0034; H01Q 9/32; H01Q 9/16; H01Q 13/10; H01Q 13/085; H01Q 13/106
See application file for complete search history.

(56) References Cited

OTHER PUBLICATIONS

Ma, G. et al., "Local oscillator radiation from active integrated antennas", Electronics Letters, vol. 35, No. 25 (Dec. 9, 1999). (2 pages).

* cited by examiner

APERTURE COUPLED PATCH ANTENNA ARRANGEMENT

CROSS REFERENCE TO RELATED APPLICATION(S)

This application is a 35 U.S.C. § 371 National Stage of International Patent Application No. PCT/EP2016/067643, filed Jul. 25, 2016, designating the United States.

TECHNICAL FIELD

The present disclosure relates to microwave antenna systems capable of transmitting and receiving microwave radiation, and in particular to an aperture coupled patch antenna arrangement for use in a microwave antenna system.

BACKGROUND

Aperture coupled patch antennas are often used in the field of microwave radio communication. Aperture coupled patch Antennas are known for good performance on e.g. cross polarization.

From U.S. Pat. No. 4,903,033 it is known that a dual polarization aperture coupled antenna usable for microwave signals. Orthogonal linearly polarized signals can be transmitted, and received, via a number of microstrip patches and a ground plane aperture which is in the shape of two orthogonal slots intersecting at their midpoints. Two identical fork shaped signal feed networks feed signals to and from the slots.

Aperture coupled antennas are often cavity backed, as the antenna described in U.S. Pat. No. 5,896,107. For antenna integrated radio products and Advanced Antenna System (AAS) products the radio is often located in a layer behind the antenna. The cavity solution in U.S. Pat. No. 5,896,107 gives a problem to connect the antenna to the radio located in the layer behind the antenna. Cables and/or connectors are needed and hence cost and power loss added.

Accordingly, there is a need for an improved antenna arrangement for use in the field of microwave radio communication.

SUMMARY

In view of above-mentioned and other drawbacks of the prior art, it is an object of the present invention to provide an improved aperture coupled patch antenna arrangement for use in a microwave radio communication system.

According to a first aspect, it is provided an aperture coupled patch antenna comprising a substrate comprising a planar electrically conductive ground plane, an electrically conductive box arranged on and electrically connected to the ground plane to form an air filled cavity between the box and the ground plane, the box comprising an aperture in the form of at least one elongate slot. The antenna further comprises an electrically conductive patch arranged in parallel with the ground plane and at a distance from the box such that the aperture of the box is located between the patch and the ground plane and a distribution network comprising at least one elongate distribution element arranged in parallel with the ground plane between the ground plane and the patch, at a distance from the substrate and the ground plane and at a distance from the box such that a gap is formed between the distribution element and the box, wherein the extension of the distribution element intersects the extension of the aperture.

Hereby, a patch antenna including a distribution element is provided which exhibits reduced dielectric losses as a result of the distribution element being arranged at a distance from the box, i.e. free hanging, without the need for a supporting circuit board. Moreover, the antenna can be fabricated separately using known manufacturing techniques after which it can be mounted on a substrate such as a circuit board. An advantage of arranging the antenna directly on a circuit board is that there is no need for connectors between the circuit board and the antenna since the antenna feed can be connected directly to a transmission line of the circuit board, e.g. by soldering.

According to some aspects, the distribution element is located between the box and the ground plane.

By arranging a distribution element arranged inside the box, efficient shielding of the distribution element from adjacent antennas is provided, thereby leading to lower distortion. This is particularly advantageous when the antenna is used in an array of antennas.

According to some aspects, the antenna arrangement further comprises at least one support element arranged between the box and the distribution element to suspend the distribution element at a distance from the box.

Hereby, the support element provides mechanical support for the distribution element to enable various configurations of antennas comprising one or more distribution elements.

According to some aspects, the distribution element is arranged to be in contact with the substrate at one point of the substrate.

According to some aspects, the distribution element is arranged to be in contact with the substrate at two points of the substrate, thereby providing additional mechanical support for the distribution element.

According to some aspects, the aperture comprises two intersecting orthogonal slots, and the distribution network comprises two distribution elements, each distribution element intersecting a corresponding slot.

Hereby, a dual polarized aperture coupled patch antenna is provided.

The object stated above is further obtained by a method for manufacturing an aperture coupled patch antenna comprising: providing an electrically conductive box comprising an aperture in the form of at least one elongate slot, the box being open on the side opposing the side of the aperture; arranging an electrically conductive patch suspended on an outside of the box in parallel with the side of the box comprising the aperture and at a distance from the box; providing a distribution network comprising at least one elongate distribution element arranged in parallel with and at a distance from the side of the box comprising the aperture such that the aperture is located between the distribution element and the patch, wherein the extension of the distribution element intersects the extension of the aperture; providing a substrate comprising a planar electrically conductive ground plane; and arranging the conductive box on the ground plane to form an air filled cavity between the box and the ground plane.

Hereby, as discussed above in connection to the antenna as such, an improved aperture coupled patch antenna can be manufactured in an efficient manner at low cost and at high volumes. Further aspects discussed in relation to the antenna are equally applicable for the method for manufacturing an aperture coupled patch antenna.

Generally, all terms used in the claims are to be interpreted according to their ordinary meaning in the technical field, unless explicitly defined otherwise herein. All references to "a/an/the element, apparatus, component, means, step, etc." are to be interpreted openly as referring to at least one instance of the element, apparatus, component, means, step, etc., unless explicitly stated otherwise. The steps of any method disclosed herein do not have to be performed in the exact order disclosed, unless explicitly stated. Further features of, and advantages with, the present invention will become apparent when studying the appended claims and the following description. The skilled person realize that different features of the present invention may be combined to create embodiments other than those described in the following, without departing from the scope of the present invention.

BRIEF DESCRIPTION OF THE DRAWINGS

The present technique is now described, by way of example, with reference to the accompanying drawings, in which.

DETAILED DESCRIPTION

The present invention will now be described more fully hereinafter with reference to the accompanying drawings, in which certain aspects of the invention are shown. This invention may, however, be embodied in many different forms and should not be construed as limited to the embodiments and aspects set forth herein; rather, these embodiments are provided by way of example so that this disclosure will be thorough and complete, and will fully convey the scope of the invention to those skilled in the art. Like numbers refer to like elements throughout the description.

In the following detailed description, various aspects of the aperture coupled patch antenna according to the present technique are mainly described with reference to an antenna for use in a communications system.

Figure 1:
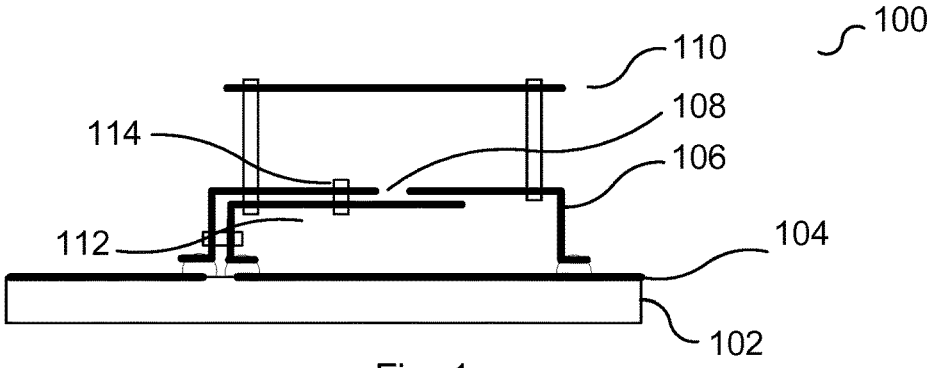
FIG. 1 schematically illustrates an antenna according to an embodiment of the present technique.

FIG. 1 schematically illustrates an aperture coupled patch antenna 100 comprising a substrate 102 in turn comprising a planar electrically conductive ground plane 104, an electrically conductive box 106 arranged on and electrically connected to the ground plane 104 to form an air filled cavity between the box 106 and the ground plane 104. The box 106 comprises an aperture 108 in the form of at least one elongate slot. An electrically conductive patch 110 is arranged in parallel with the ground plane 104 and at a distance from the box 106 such that the aperture 108 of the box 106 is located between the patch 110 and the ground plane 104. The antenna 100 further comprises a distribution network comprising at least one elongate distribution element 112 arranged in parallel with the ground plane 104 between the ground plane 104 and the patch 110, at a distance from the substrate 102 and the ground plane 104 and at a distance from the box 106 such that a gap is formed between the distribution element 112 and the box 106, wherein the extension of the distribution element 112 intersects the extension of the aperture 108.

Hereby, a low-loss aperture coupled patch antenna 100 is provided where the losses in the distribution element 112 are reduced as a result of the distribution element 112 being arranged at a distance from the box 106 such that a gap is formed. The gap is here illustrated as an air gap. Accordingly, there is no need for any additional element between the distribution element 112 and the box 106, or between the distribution element 112 and the ground plane 104. In particular, the distribution element 112 can be seen as free hanging or suspended since the distribution element 112 is not arranged on a circuit board or the like, thereby leading to reduced losses. Moreover, there is no need for a specific RF-connector to the antenna since the antenna is mounted directly on a substrate such as a circuit board, e.g. a radio board. The substrate may also be a metallic plate.

The ground plane 104 is typically provided in the form of a metallic layer on the substrate 102, the metallic layer being connected to a ground potential. Herein, the extension of distribution element 112 refers to the length direction of the elongate distribution element 112. Similarly, the extension of the aperture 108 refers to the length direction of the elongate aperture 108 as will be illustrated in further detail in the following.

The box 106 illustrated in FIG. 1 is open on the side facing the substrate 102 such that the box 106 and the substrate 102 form a substantially enclosed cavity, with the exception of the aperture 108 forming an opening in the box 106 in the direction of the patch 110. Moreover, the box 106 is typically a metal box, similar to a shielded box.

It should further be noticed that the described antenna operates according to well established principles for conventional aperture coupled patch antennas known by the skilled person. Therefore, dimensions and further properties of the antenna will not be discussed in detail in the present description.

As illustrated in FIG. 1, the distribution element 112 is located between the box 106 and the ground plane 104. Thereby, the distribution element 112 is shielded from distortions, e.g. from adjacent antennas or other components. Moreover, the distribution element 112 is arranged to be in contact with the substrate 102 at one point of the substrate 102.

FIG. 1 further illustrates at least one support element 114 arranged between the box 106 and the distribution element 112 to suspend the distribution element 112 at a distance from the box 106. Support elements 114 are also arranged between the patch 110 and the box 106 to arrange the patch 110 in the appropriate position in relation to the box 106. The support elements 114 are electrically insulating, i.e. non-conductive, and provide mechanical support for the patch 110 and the distribution element 112. In particular, as illustrated in FIG. 1, the distribution element 112 is suspended from the box 106 by means of support elements 114. Moreover, the support elements 114 determine the distances between e.g. the distribution element 112 and the ground plane 104 which in turn influence the properties of the antenna 100. In embodiments comprising support elements 114 between the box 106 and the distribution element 112, the air gap is thus formed along at least part of the length of the distribution element 112 and the box 106.

In the embodiments described herein, the distribution element 112 is a microstrip transmission line.

Figure 2:
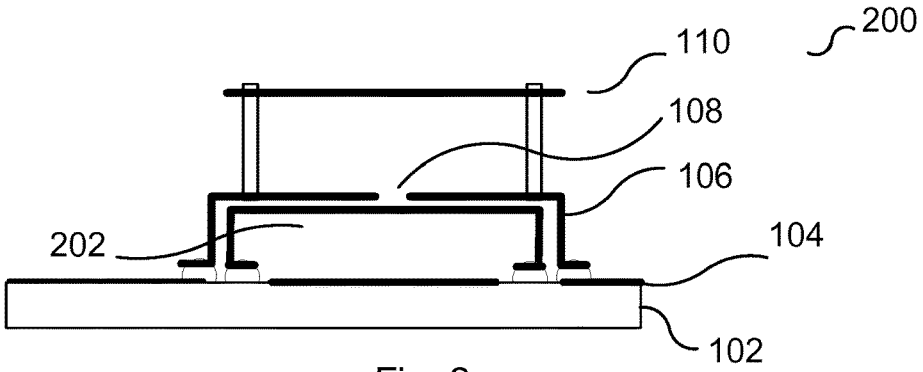
FIG. 2 schematically illustrates an antenna according to an embodiment of the present technique.

FIG. 2 schematically illustrates an antenna 200 where the distribution element 202 is arranged to be in contact with the substrate 102 at two points of the substrate 202, thereby providing additional mechanical stability of the distribution element 202. Thereby, the support elements between the box 106 and the distribution element 202 may be reduced or eliminated.

Figure 3A:
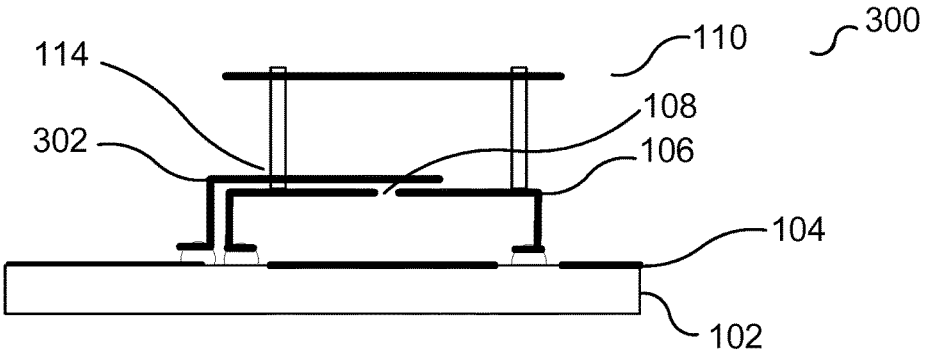
FIGS. 3A-B schematically illustrate antennas according to embodiments of the present technique.
Figure 3B:
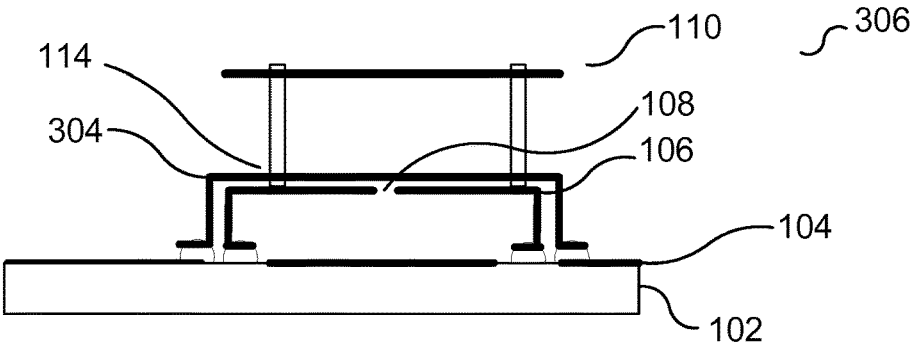

FIGS. 3A-B schematically illustrate an antenna 300, 306 where the distribution element 302, 304 is located between the box 106 and the patch 110. By arranging the distribution element outside of the box, it is possible to visually inspect the distribution element e.g. to identify any damage to the element, which for example may occur during assembly of the antenna.

In FIG. 3B the distribution element 304 is in contact with the substrate 102 at two points of the substrate 102, thereby forming a bridge outside of the box 106. The distribution element 304 in the form of a bridge is more mechanically stable in comparison to a distribution element having only one point of contact with the substrate.

Even though the box 106 in FIGS. 3A-B is illustrated as a box being open in the direction of the circuit board, the 102, the box may equally well be fully closed with the only opening being the aperture 108 of the box. Thereby, the air filled cavity is formed within the box.

Figure 4A:
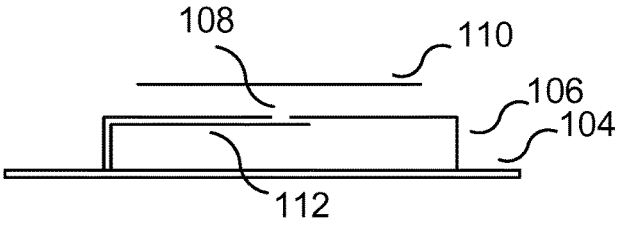
FIGS. 4A-C schematically illustrate an antenna according to an embodiment of the present technique.
Figure 4B:
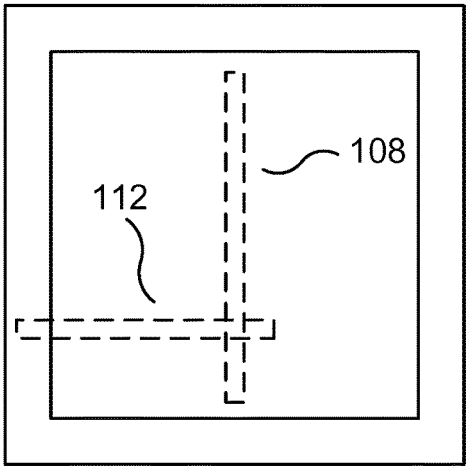
Figure 4C:
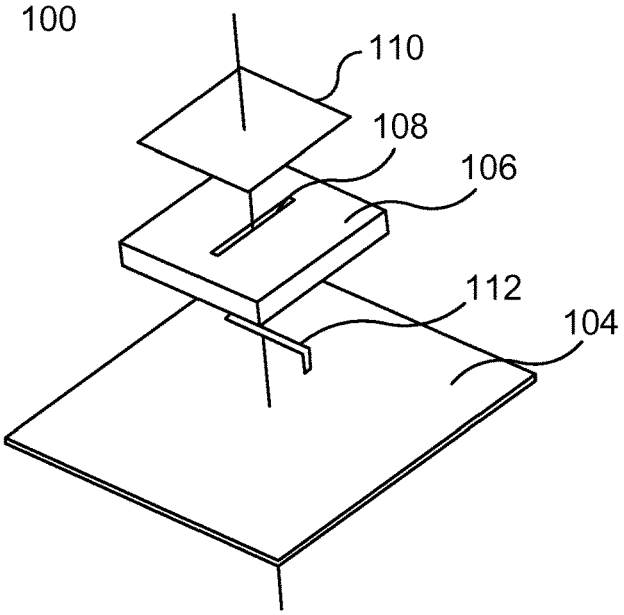

FIGS. 4A-C illustrate the antenna 100 of FIG. 1 in further detail where FIG. 4B is a schematic top view of the antenna and FIG. 4C is an exploded view showing selected components of the antenna 100. FIG. 4A is a top view of the antenna 100 illustrating the alignment of the distribution element 112 in relation to the aperture 108. Here, the aperture 108 comprises one elongate slot and the distribution element 112 comprises one elongate strip being arranged orthogonally to the aperture 108 and intersecting the aperture 108. It should be noted that many different configurations of one or more distribution elements are possible, in a similar manner as for previously known aperture coupled patch antennas.

FIG. 4C is an exploded view illustrating components of the antenna 100 and the order in which they are arranged to form the described antenna 100. The distribution element 112 is thus located between the box 106 and the ground plane 104. Even though the box 106 is illustrated herein as a rectangular box, the box may also have a circular outline as seen from above, i.e. as seen from the direction of the patch. Moreover, the patch may also have other shapes, such as circular.

Figure 5A:
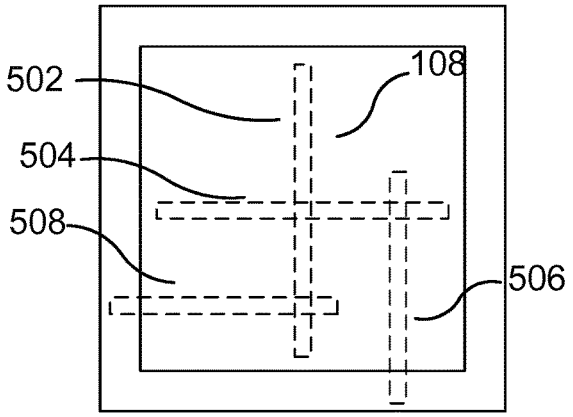
FIGS. 5A-C schematically illustrate an antenna according to an embodiment of the present technique.
Figure 5B:
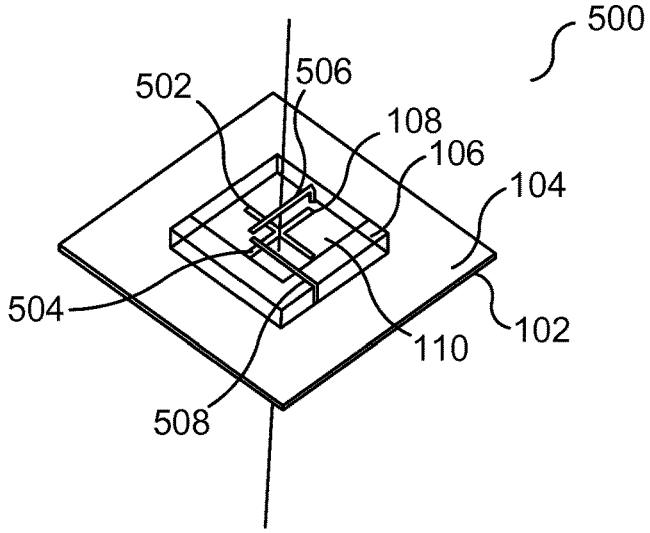
Figure 5C:
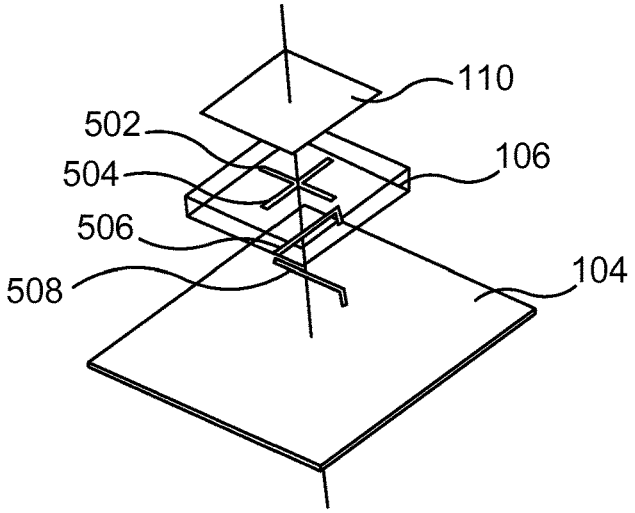

FIGS. 5A-C illustrate an antenna 500 where the aperture comprises two intersecting orthogonal slots 502, 504, and wherein the distribution network comprises two distribution elements 506, 508, each distribution element 506, 508 intersecting a corresponding slot 502, 504. FIG. 5A is a top view of the antenna 500, FIG. 5B is a perspective view of the antenna 500 and FIG. 5C is an exploded view illustrating the orientation of selected components of the antenna 500.

As can be seen in FIG. 5A, the two distribution elements 506, 508 are elongated and arranged orthogonally to each other. Each distribution element 506, 508 is orthogonally aligned with respect to a corresponding opening, i.e. slot 502, 504, of the aperture 108. Hereby, a dual polarized antenna is provided.

The described antenna may advantageously be used in an antenna array comprising a plurality of antennas according to any one of the above described embodiments.

Figure 6:
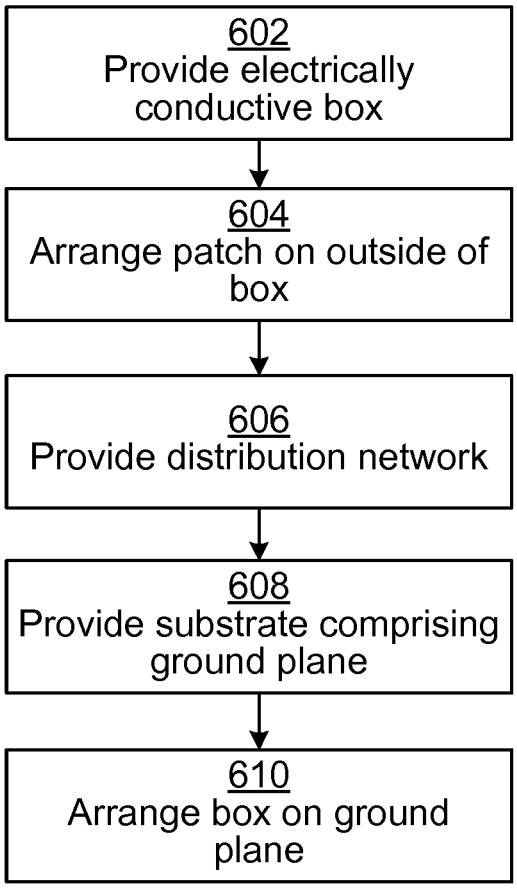
FIG. 6 is a flow chart outlining the general steps of a method according to an embodiment of the present technique.

FIG. 6 outlines the general steps of a method for manufacturing an aperture coupled patch antenna 100, 200, 300, 500. The method comprises providing 602 an electrically conductive box 106 comprising an aperture 108 in the form of at least one elongate slot, the box 106 being open on the side opposing the side of the aperture 108, arranging 604 an electrically conductive patch 110 suspended on an outside of the box 106 in parallel with the side of the box 106 comprising the aperture 108 and at a distance from the box 106; providing 606 a distribution network comprising at least one elongate distribution element 112, 202, 302, 304 arranged in parallel with the ground plane 104 between the ground plane 104 and the patch 110, at a distance from the substrate 102 and the ground plane 104 and at a distance from the box 106 such that a gap is formed between the distribution element 112 and the box 106, such that the extension of the distribution element 112 intersects the extension of the aperture 108. The method further comprises providing 608 a substrate 102 comprising a planar electrically conductive ground plane 104; and arranging 610 the conductive box 106 on the ground plane 104 to form an air filled cavity between the box 106 and the ground plane 104.

The described manufacturing method provides a straightforward and easily scalable manufacturing process suited for low cost high volume production of surface mounted aperture coupled antennas. The box 106 is similar to the type of box which is used for shielding box technologies, and well known shielding box manufacturing methods can easily be modified to provide a manufacturing process for the various embodiments of the antenna described herein.

In particular, by soldering the distribution network and the box to the circuit board, known production method can be used. The distribution network and the box can be individually mounted on the substrate as separate components. However, it may be even more preferable to assemble the distribution network and the box prior to mounting on the substrate such that only one step is required when soldering the antenna to the substrate.

This may for example be achieved by suspending the distribution element from the box by means of a suspension element.

Moreover, the distribution element can be made in many different ways. For example, the distribution element may be pre-mounted on the substrate with a box being subsequently arranged over the distribution element, the distribution element may be suspended from the inside or outside of the box by means of plastic support elements, and the distribution element may be made in metal or as metallized plastic.

Even though the invention has been described with reference to specific exemplifying embodiments thereof, many different alterations, modifications and the like will become apparent for those skilled in the art from a study of the drawings, the disclosure, and the appended claims. Also, it should be noted that parts of the connector arrangement may be omitted, interchanged or arranged in various ways, the connector arrangement yet being able to perform the functionality of the present invention. The mere fact that certain measures are recited in mutually different dependent claims does not indicate that a combination of these measured cannot be used to advantage. Additionally, variations to the disclosed embodiments can be understood and effected by the skilled person in practicing the claimed invention. In the claims, the word "comprising" does not exclude other elements or steps, and the indefinite article "a" or "an" does not exclude a plurality.

The invention claimed is:

1. An aperture coupled patch antenna comprising:

a substrate comprising a planar electrically conductive ground plane;

an electrically conductive box arranged on and electrically connected to the planar electrically conductive ground plane to form an air filled cavity between the electrically conductive box and the planar electrically conductive ground plane, the electrically conductive box comprising an aperture in the form of at least one elongate slot;

an electrically conductive patch arranged in parallel with the planar electrically conductive ground plane and at a distance from the electrically conductive box such that the aperture of the electrically conductive box is located between the electrically conductive patch and the planar electrically conductive ground plane; and a distribution network comprising at least one elongate distribution element arranged in parallel with the planar electrically conductive ground plane between the planar electrically conductive ground plane and the electrically conductive patch, at a distance from the substrate and the planar electrically conductive ground plane and at a distance from the electrically conductive box such that a gap is formed between the at least one elongate distribution element and the electrically conductive box, wherein an extension of the at least one elongate distribution element intersects an extension of the aperture.

2. The aperture coupled patch antenna of claim 1, wherein the at least one elongate distribution element is located between the electrically conductive box and the planar electrically conductive ground plane.

3. The aperture coupled patch antenna of claim 2, further comprising at least one support element arranged between the electrically conductive box and the at least one elongate distribution element to suspend the at least one elongate distribution element at a distance from the electrically conductive box.

4. The aperture coupled patch antenna of claim 3, wherein the at least one support element is electrically insulating.

5. The aperture coupled patch antenna of claim 1, wherein the at least one elongate distribution element is located between the electrically conductive box and the electrically conductive patch.

6. The aperture coupled patch antenna of claim 1, wherein the at least one elongate distribution element is arranged to be in contact with the substrate at one point of the substrate.

7. The aperture coupled patch antenna of claim 1, wherein the at least one elongate distribution element is arranged to be in contact with the substrate at two points of the substrate.

8. The aperture coupled patch antenna of claim 1, wherein the substrate is a circuit board.

9. The aperture coupled patch antenna of claim 1, wherein the at least one elongate distribution element is a microstrip transmission line.

10. The aperture coupled patch antenna of claim 1, wherein the aperture comprises two intersecting orthogonal slots, and wherein the distribution network comprises two distribution elements, each distribution element intersecting a corresponding slot.

11. The aperture coupled patch antenna of claim 10, wherein the two distribution elements are elongated and arranged orthogonally to each other.

12. An antenna array comprising a plurality of antennas of claim 1.

13. A method for manufacturing an aperture coupled patch antenna, the method comprising:

providing an electrically conductive box comprising an aperture in the form of at least one elongate slot, the electronically conductive box being open on a side opposing a side of the aperture;

arranging an electrically conductive patch suspended on an outside of the electrically conductive box in parallel with the side of the electrically conductive box comprising the aperture and at a distance from the electrically conductive box;

providing a distribution network comprising at least one elongate distribution element arranged in parallel with a planar electrically conductive ground plane between the planar electrically conductive ground plane and the planar electrically conductive patch, at a distance from a substrate and the planar electrically conductive ground plane and at a distance from the electrically conductive box such that a gap is formed between the at least one elongate distribution element and the electrically conductive box, such that an extension of the at least one elongate distribution element intersects an extension of the aperture;

providing the substrate comprising the planar electrically conductive ground plane; and arranging the electrically conductive box on the planar electrically conductive ground plane to form an air filled cavity between the electrically conductive box and the planar electrically conductive ground plane.

14. The method of claim 13, further comprising suspending the at least one elongate distribution element from the electrically conductive box by means of a suspension element.

15. The method of claim 13, further comprising soldering the distribution network and the electrically conductive box to a circuit board.

* * * * *